US006682461B2

(12) United States Patent
Wang et al.

(10) Patent No.: US 6,682,461 B2
(45) Date of Patent: Jan. 27, 2004

(54) METHOD FOR CONTROLLING AN ELECTRIC TREADMILL

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 168 days.

(21) Appl. No.: 10/067,657

(22) Filed: Feb. 7, 2002

(65) Prior Publication Data

US 2003/0148854 A1 Aug. 7, 2003

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,368,532 A * 11/1994 Farnet ..... 482/54
6,126,575 A * 10/2000 Wang ..... 482/54
6,135,924 A * 10/2000 Gibbs et al. ..... 482/54

* cited by examiner

*Primary Examiner*—Glenn E. Richman
(74) *Attorney, Agent, or Firm*—Kuo-Hsiung Chiu

(57) ABSTRACT

The present invention relates to a method for controlling an electric treadmill which includes emission type sensor sets (e.g. infrared, etc.) arranged at two proper places of the treadmill and connected to the control console, thereby creating air sensing fields covering a specific range. Therefore, the operator can give any intentional signal that is detectable by the sensor during the walking exercise session. Thereafter, the sensor orders the control console to perform a control action to the controlled motor on receipt of the intentional signal of the operator.

7 Claims, 1 Drawing Sheet

METHOD FOR CONTROLLING AN ELECTRIC TREADMILL

BACKGROUND OF THE INVENTION

1. Fields of the Invention

The present invention relates to a method for controlling an electric treadmill, and more particularly, to a method through which the operator can instruct the control console to perform preset commands to the motor without touching the control console.

2. Description of the Prior Art

As well known, each electric treadmill is fitted with a transmission system of motor at the bottom end thereof for an in-place rotation of the continuous belt so that the operator can stand on the continuous belt to take in-place walking exercise. This electric treadmill is normally provided with a control console at a proper place thereof, and a number of control keys are disposed at another proper place thereof to facilitate the setting of the desired rotational speed of the continuous belt.

In addition, the electric treadmill is provided with a stepper motor. The supported angle of the base frame is adjustable by means of the forward and backward rotation of motor together with the lifting assembly. This adjustment is carried out by different control keys.

No matter where the control keys are situated, the operator has to look for the correct position of the control keys by sight and continuously or repeatedly press down the control keys for adjusting the rotational speed of the continuous belt or the supported angle of the base frame. These actions will divert the operator's attention and cause inconvenience due to strange walking position of the operator.

SUMMARY OF THE INVENTION

It is a primary object of the present invention to eliminate the above-mentioned drawbacks and to provide a method for controlling an electric treadmill utilizing sensitive and effective emission type sensor sets and air sensing fields to carry out the control action without touching the control console.

BRIEF DESCRIPTION OF THE DRAWINGS

The accomplishment of this and other objects of the invention will become apparent from the following description and its accompanying drawing of which.

DETAILED DESCRIPTION OF THE PREFERRED EMBODIMENT

Figure 1:
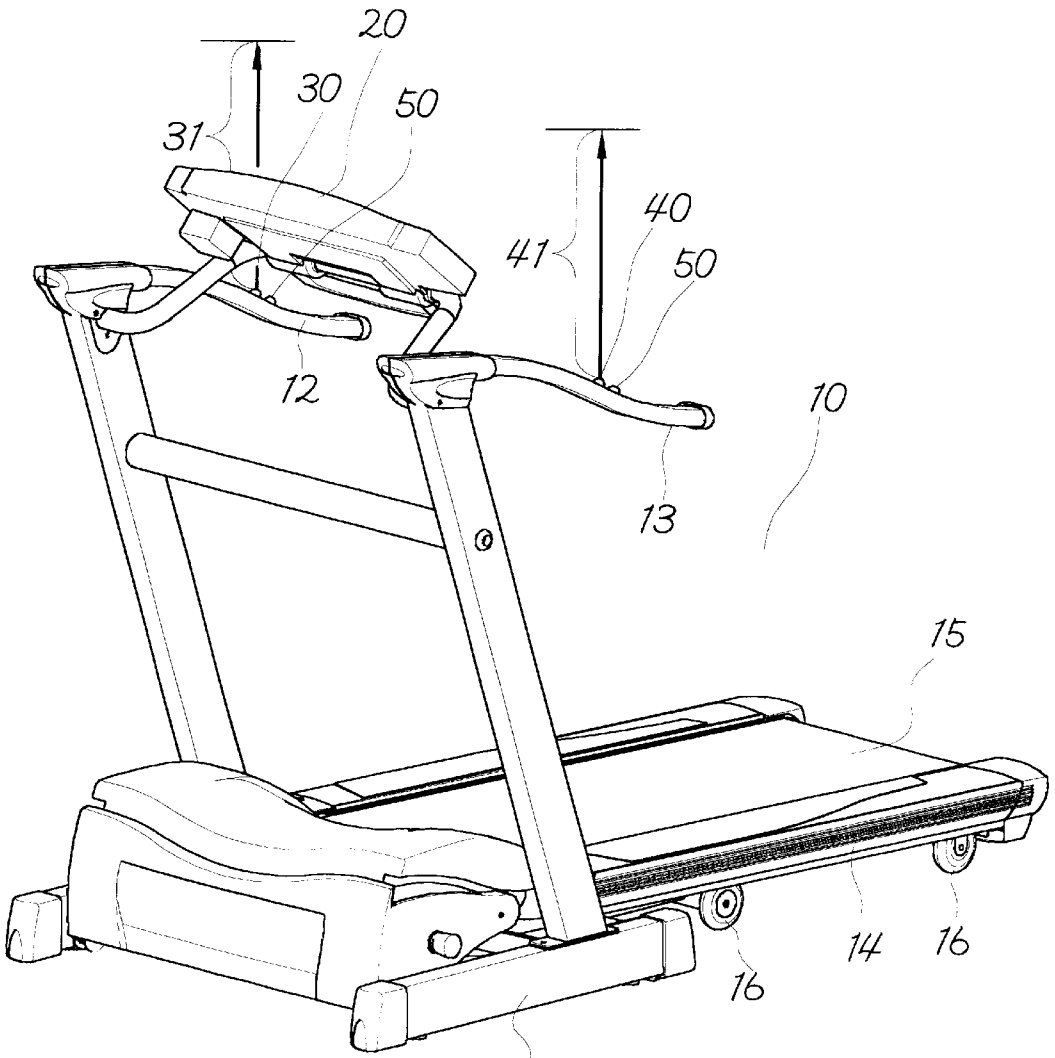
FIG. 1 is a perspective view of a preferred embodiment of the present invention.

First of all, referring to FIG. 1, the electric treadmill 10 of the preferred embodiment of the present invention includes an upright frame 11, two handrails 12, 13, a control console 20, a base frame 14, a continuous belt 15 and bottom supporting elements 16. Two emission type sensor sets 30, 40 (e.g. infrared, etc.) connected to the control console 20 are fitted to the handrails 12, 13 of the electric treadmill 10, respectively. Thus, air sensing fields 31, 41 covering a specific range are formed above both handrails 12, 13. Therefore, the operator can give any intentional signal that is detectable by the sensor sets during the walking exercise session. Thereafter, the sensor orders the control console to perform a preset control action to the controlled motor (not shown) on receipt of the intentional signal of the operator. This is named by the inventor as air control mode.

Under the pre-condition that the walking exercise of the operator won't be influenced, the effective detection range (including width and height) of air sensing fields 31, 41 should be possibly set within the height of the treadmill and the operator for fear of interference by other objects.

Both above-mentioned emission type sensor sets 30, 40 are in control of opposite commands for motor, that is, one controls the acceleration of the motor while the other controls the deceleration thereof. When both emission type sensor sets 30, 40 detect something, the motor is controlled to stop in consideration of user's safety and motor's protection. When the sensed state lasts for a longer time, it means a greater range of acceleration or deceleration. Hence, the present invention can be controlled by swinging both hands in the air sensing fields 31, 41, thereby creating the convenience and the practicalness of the present invention.

The air control mode can also be used to control the supported angle of the base frame 14. However, the control motor (not shown, and it's normally a stepper motor performing the forward and backward rotation) is different from the motor in connection with the continuous belt 15. In brief, the air control mode can be designed as desired either to control the rotational speed of the continuous belt 15 or to control the supported angle of the base frame 14. Certainly, the air control mode can be designed to control both the rotational speed and the supported angle.

The air control mode can be fitted together with the control console 20 so that the operator can choose either of them for control. In other words, the user can use either the conventional control keys to reach the expected control effect or the air control mode while no interference to each other will happen. Moreover, the air sensing fields 31, 41 won't interfere with the in-place walking exercise area. And the control of the present invention is completely carried out by the subjective will of the operator so that the use safety can be fully ensured.

When the air control mode is activated, a warning light 50 is switched on in order to remind others adjacent to the treadmill of the air control mode in operation state to avoid unexpected detection.

Furthermore, a hidden speaker (not shown) can be fitted to the air control mode so that a sound with certain volume can be given out to inform the user of the current operation state when any signals are sensed. Moreover, different operation states can be differentiated by giving a high or low sound for acceleration or deceleration and lifting or lowering, a long or short sound for the range of the acceleration or deceleration and lifting or lowering. This design is especially beneficial for the visually handicapped.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A method for controlling an electric treadmill providing emission type sensor sets arranged at two proper places of said treadmill and connected to a control console, thereby creating air sensing fields covering a specific range so that the operator can give any intentional signal which is detectable by said sensor during the walking exercise session, whereupon the sensor orders said control console to perform a preset control action (named as air control mode) upon the controlled motor on receipt of the intentional signal of the operator.

2. The method as recited in claim 1, wherein said air control mode is available and used together with said control console.

3. The method as recited in claim 1, wherein a warning light is switched on when said air control mode is activated.

4. The method as recited in claim 1, wherein a hidden speaker is fitted to said air control mode so that a sound with certain volume can be given out to inform the user of the current operation state when any signals are sensed.

5. A method for controlling an electric treadmill comprising an upright frame, two handrails, a control console, a base frame, a continuous belt and bottom supporting elements and providing emission type sensor sets arranged at two proper places of said treadmill and connected to a control console, thereby creating air sensing fields covering a specific range so that the operator can give any intentional signal which is detectable by said sensor during the walking exercise session, whereupon said sensor orders said control console to perform a preset control action (named as air control mode) upon the controlled motor on receipt of the intentional signal of the operator.

6. The method as recited in claim 5, wherein a warning light is switched on when said air control mode is activated.

7. The method as recited in claim 5, wherein a hidden speaker is fitted to said air control mode so that a sound with certain volume can be given out to inform the user of the current operation state when any signals are sensed.

* * * * *